US006516759B2

(12) United States Patent
Takahashi et al.

(10) Patent No.: US 6,516,759 B2
(45) Date of Patent: Feb. 11, 2003

(54) VALVE TIMING CONTROL APPARATUS FOR INTERNAL COMBUSTION ENGINE

(75) Inventors: Tatsuhiko Takahashi, Hyogo (JP); Morio Fujiwara, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/887,171

(22) Filed: Jun. 25, 2001

(65) Prior Publication Data

US 2002/0100440 A1 Aug. 1, 2002

(30) Foreign Application Priority Data

Feb. 1, 2001 (JP) ..... 2001-025747

(51) Int. Cl.[7] ..... F01L 1/34

(52) U.S. Cl. ..... 123/90.15; 123/90.16; 123/90.17; 123/90.18; 123/90.12; 123/90.31

(58) Field of Search ..... 123/90.15, 90.17

(56) References Cited

U.S. PATENT DOCUMENTS 5,400,747 A * 3/1995 Tabata et al. ..... 123/90.17
5,522,352 A * 6/1996 Adachi et al. ..... 123/90.15
5,562,071 A * 10/1996 Urushihata et al. ..... 123/90.15
5,611,304 A * 3/1997 Shinojima ..... 123/90.15
5,678,515 A * 10/1997 Kato et al. ..... 123/90.15
6,244,230 B1 * 6/2001 Mikame ..... 123/90.17
6,260,524 B1 * 7/2001 Wachi ..... 123/90.15
6,283,074 B1 * 9/2001 Takahashi et al. ..... 123/90.15
6,311,655 B1 * 11/2001 Simpson et al. ..... 123/90.17

FOREIGN PATENT DOCUMENTS

JP 7-229409 8/1995
JP 11-132064 5/1999

* cited by examiner

*Primary Examiner*—Thomas Denion
*Assistant Examiner*—Ching Chang
(74) *Attorney, Agent, or Firm*—Sughrue Mion, PLLC

(57) ABSTRACT

A valve timing control apparatus for an internal combustion engine is capable of ensuring good response within a control range, stability outside the control range, and durability without increasing the capacity of electric power for a drive circuit and an OCV coil. The valve timing control apparatus includes an intake vale 31, an exhaust valve 32, an engine operating condition detecting section (3, 11, 14), a target valve timing calculating section 21, variable valve timing mechanisms 15, 16, an actual valve timing detecting section (14, 17, 18), a control amount calculating section 21 for calculating a control amount based on target valve timing, actual valve timing and engine operating conditions, and an actual valve timing control section (19, 20) for outputting the control amount as an output control amount to the variable valve timing mechanisms. When the target valve timing is outside a prescribed control range, the control amount calculated by the control amount calculating section 21 is not made as an output control amount supplied to the actual valve timing control section (19, 20).

9 Claims, 12 Drawing Sheets

VALVE TIMING CONTROL APPARATUS FOR INTERNAL COMBUSTION ENGINE

This application is based on Application No. 2001-025747, filed in Japan on Feb. 1, 2001, the contents of which are hereby incorporated by reference.

BACKGROUND OF THE INVENTION

1. Field of the Invention

The present invention relates to the valve timing control apparatus for an internal combustion engine for controlling the opening and/or closing timing of intake valves and/or exhaust valves of the internal combustion engine.

2. Description of the Related Art

In a valve timing control apparatus in which cam angles representative of the rotational positions of cams mounted on camshafts, respectively, for operating intake valves and exhaust valves are controlled to retard or advance with respect to the crank angle of a crankshaft of an internal combustion engine, it has been known in the past that when the amount of actual advanced angle is moving toward the amount of target advanced angle by more than a prescribed value, the calculation of an integral value is controlled to stop.

First, such known valve timing control will be described below. FIG. 2 is an explanatory view illustrating the phase shift range of a known valve timing control apparatus for an internal combustion engine represented by the relation between the amount of valve lift and the crank angle position of the crankshaft. In addition, FIGS. 4 through 6 are perspective views illustrating the internal structure, at a maximum retarded angle position, a locked position and a maximum advanced angle position, respectively, of a valve actuator provided with a variable valve timing mechanism (hereinafter referred to as a VVT mechanism) for individually varying the valve timing (i.e., opening or closing timing) of each of the intake valves and exhaust valves.

The valve timing is variable between a curve indicated by an alternate long and short dash line and another curve indicated by a broken line, as illustrated in FIG. 2. Such a variable range of the valve timing is determined by an operable or movable range of vanes 152 of the valve actuator within a housing 151, as illustrated in FIG. 4 to FIG. 6. FIG. 4 is a maximum retarded angle position of the vanes 152 relative to the housing 151, and FIG. 6 is a maximum advanced angle position thereof. The actuator is mounted on the camshaft for making the cam angle (i.e., the rotational position of the camshaft) variable relative to the crank angle (i.e., the rotational position of the crankshaft).

Next, a basic operation of this known valve timing control apparatus will be described according to flow charts of FIGS. 17 and 18 and a timing chart of FIG. 19. FIG. 17 illustrates a flow chart relating to the operation of the prior art. In FIG. 17, first in step 1701, the amount of an actual advanced angle VTd is detected from outputs of a cam angle sensor, which detects the cam angle of the camshaft, and a crank angle sensor, which detects the crank angle of the crankshaft. Then in step 1702, a proper target valve timing, i.e., the amount of a target advanced angle VTt suitable for engine operating conditions, is calculated. In step 1703, the actual advanced angle amount VTd is subtracted from the target advanced angle amount VTt to provide a control deviation VTe.

Subsequently, in step 1704, the control deviation VTe is multiplied by a proportional gain Pgain to provide a proportional value Ip. In step 1705, a difference between the current control deviation VTe and the last control deviation VTe(i−1) is multiplied by a derivative gain Dgain to provide a derivative value Id. In step 1706, an integral value Ii is calculated.

The calculation of the integral value Ii is performed according to the flow chart of FIG. 18. That is, first in step 1801, when an absolute value |VTe| of the control deviation VTe is greater than an absolute value |VTe(i−1)| of the last control deviation VTe(i−1), it is determined that the actual advanced angle amount VTd does not follow the target advanced angle amount VTt. Then, in step 1802, the integral value Ii is added by the result of multiplication of the control deviation VTe and the integral gain Igain to provide an updated integral value Ii . Otherwise, when the absolute value |VTe| of the control deviation is less than the absolute value of the last deviation |VTe(i−1)| in step 1801, nothing is done so the integral value Ii is not updated and the last value is maintained as it is.

Returning to FIG. 17, in step 1707, it is determined whether the absolute value |VTe| of the control deviation is equal to or less than a reference value VTh for determination of whether the actual advanced angle amount is in a steady state. When it is determined that the absolute value |VTe| is greater than the reference value VTh, then in step 1708, an output current value Iout is calculated by adding a holding current learned value Ih, the proportional value Ip, the derivative value Id, and the integral value Ii together. When it is determined in step 1707 that the absolute value |VTe| is less than the reference value VTh, the holding current learned value Ih and the integral value Ii are added to each other to provide an output current value Iout.

Thereafter in step 1710, the output current value Iout is converted into a corresponding duty value, which are output to oil control valves (OCVs). The oil control valves (OCVs) cooperate with an oil pump to constitute a hydraulic pressure supply system for controlling the oil pressure of each valve actuator to adjust the phase or angle of each corresponding cam and hence camshaft. The OCVs are represented by reference numerals 19 and 20 in FIG. 1 which will be later used to explain the present invention in detail. The internal structure of one of the OCVs is illustrated in FIGS. 7 through 9 for controlling the current to be supplied to a coil 193 thereby to perform the switching of oil pressure by the OCV.

Next, an actual operation of the above-mentioned known valve timing control apparatus will be described according to the timing chart of FIG. 19. FIG. 19 illustrates changes in the actual advanced angle amount VTd, the target advanced angle amount VTt, the output current value Iout and the integral value Ii. The target advanced angle amount VTt changes to the maximum advanced angle position at a time point 1901. Since a deviation between the target advanced angle amount VTt and the actual advanced angle amount VTd continues to be large until at a time point 1902, the OCV is controlled by the output current value Iout calculated by the operational expression at the time point 1708 of FIG. 17. At the time point 1902, the actual advanced angle VTd cannot follow the target advanced angle amount VTt. However, the VVT actuator is in a state fixed to the most or maximum advanced angle side, and hence it cannot be moved toward the advanced angle side any further. As a result, there still remains the deviation between the actual advanced angle amount VTd and the target advanced angle amount VTt.

From the time point 1902 to a time point 1903, the actual advanced angle amount VTd does not follow the target advanced angle amount VTt, so the integral value Ii is updated in a direction to increase. From the time point 1903 to a time point 1904, the integral value Ii is fixed to a preset upper limit integral value and exists in a state unable to increase any more. When the target advanced angle amount VTt changes to the retarded angle side at the time point 1904, the VVT actuator is controlled by the output current value Iout calculated in step 1708 of FIG. 16. However, since the integral value Ii was updated by mistake to an increasing side with the target advanced angle amount VTt being at the maximum advanced angle position, the actual advanced angle amount VTd cannot follow the target advanced angle amount VTt from the time point 1904 to the time point 1905, thus reducing the response.

Moreover, for example, Japanese Patent Application Laid-Open No. 7-229409 discloses another conventional valve timing control apparatus in which valve timing control based on a difference in phase between the crank angle and the cam angle is stopped at a high speed rotation of the engine, and instead valve timing is controlled by the maximum retarded angle. According to this prior art, in the case where the intake valve closing timing of an intake valve is made to be at the maximum retarded angle to retard the intake valve closing timing for the purpose of achieving the effect of inertia supercharging at a high speed rotation of the engine, an error in the detected phase difference between the crank angle and the cam angle grows greater as the rotational speed of the engine increases, and to prevent this, the control value is fixed at the maximum retarded angle during the high speed rotation of the engine.

With the known valve timing control apparatuses as described above, the range in which the valve timing can be varied is from the maximum advanced angle position to the maximum retarded angle position. Thus, there arises the following problem; that is, in case where even with the target advanced angle amount becoming the maximum advanced angle position, there remains a deviation between the actual advanced angle and the target advanced angle amount due to the fact that the actual advanced angle can not actually follow the target advanced angle amount owing to detection errors on the part of the means for actually detecting the valve timing, the insufficient working accuracy of the variable valve timing mechanism, etc., the integral value is updated so that the response reduces when the target advanced angle amount exceeds the maximum advanced angle position.

In addition, in the case where control is performed with the actuator being at a mechanical stop position thereof, the control position of the actuator becomes more stable when the actuator is controlled to be pushed against the mechanical stop position rather than when controlled in a feedback manner. Thus, there also arise the following problems; the detection errors on the part of the means for actually detecting the valve timing occur even in rotational speed ranges other than the high speed rotation range, and the insufficient working accuracy of the variable valve timing mechanism is an error factor irrespective of the number of revolutions per unit time of the engine.

SUMMARY OF THE INVENTION

The present invention is intended to solve the various problems as described above, and has for its object to provide a valve timing control apparatus for an internal combustion engine which is capable of ensuring not only good response when a target advanced angle amount is within a control range but also stability when the target advanced angle amount is out of the control range, thus providing durability without increasing the power capacities of a driving circuit and an OCV coil.

Thus, the valve timing control apparatus according to the present invention stops feedback control based on a deviation between a target advanced angle amount and an actual advanced angle amount, but performs control based on a fixed control value when the target advanced angle amount is out of a preset control range. In addition, updating an integral value is stopped and the integral value is not reflected on control when the target advanced angle amount is out of the preset control range. Otherwise, when the target advanced angle amount shifts from the outside of the control range into the control range, the integral value is initialized.

According to the present invention, there is provided a valve timing control apparatus for an internal combustion engine including: an intake valve and an exhaust valve being driven to operate in synchronization with rotation of the engine; an engine operating condition detecting section for detecting the operating conditions of the engine; a valve timing calculating section for calculating a target valve timing for at least one of the intake valve and the exhaust valve in accordance with the engine operating conditions; a variable valve timing mechanism for varying an opening timing and a closing timing of at least one of the intake valve and the exhaust valve; a valve timing detecting section for detecting an actual valve timing of at least one of the intake valve and the exhaust valve; a control amount calculating section for calculating a control amount based on the target valve timing, the actual valve timing and the engine operating conditions; an actual valve timing control section for outputting the control amount as an output control amount to the variable valve timing mechanism. Only when the target valve timing is within a prescribed control range, a control amount, which corresponds to a deviation between the target valve timing and the actual valve timing calculated by the control amount calculating section, is output as the output control amount to the actual valve timing control section.

In a preferred form of the present invention, when the target valve timing is outside the control range on a side where the control amount is set to a large value, the output control amount is equal to the sum of a holding control amount and a prescribed amount.

In another preferred form of the present invention, the holding control amount is the output control amount in a state in which the actual valve timing substantially matches the target valve timing when the target valve timing is within the control range.

In a further preferred form of the present invention, the valve timing control apparatus further includes a holding control amount learning section for learning the output control amount in a state in which the actual valve timing substantially matches the target valve timing when the target valve timing is within the control range.

In a yet further preferred form of the present invention, the output control amount is a current value for controlling the actual valve timing control section.

In a still further preferred form of the present invention, the holding control amount is set as a maximum control amount when the holding control amount learning section does not perform a learning operation.

In a further preferred form of the present invention, the maximum control amount of the holding control amount is a maximum value of a variation tolerance caused by the actual valve timing control section.

In a further preferred form of the present invention, the prescribed amount is set to the output control amount with which at least the actual valve timing is stopped at a mechanical stop position.

In a further preferred form of the present invention, when the control amount calculated by the control amount calculating section is greater than the sum of the holding control amount and a prescribed amount, or when the actual valve timing is within the control range, even with the target valve timing being outside the control range, the control amount calculated by the control amount calculating section is made as the output control amount.

In a further preferred form of the present invention, the valve timing control apparatus further includes an integral control section for integrating a deviation between the target valve timing and the actual valve timing to provide an integral correction value for correcting the control amount calculated by the control amount calculating section. The integral correction value is corrected to the control amount calculated by the control amount calculating section, and when the target valve timing is outside the control range, the control amount is set in such a manner as to inhibit the integral correction value from being updated.

In a further preferred form of the present invention, the valve timing control apparatus further includes an integral control section for integrating a deviation between the target valve timing and the actual valve timing to provide an integral correction value for correcting the control amount calculated by the control amount calculating section. The integral correction value is corrected to the control amount calculated by the control amount calculating section, and when the target valve timing is outside the control range, the control amount is set in such a manner as to inhibit the integral correction value from being corrected to the control amount.

In a further preferred form of the present invention, the valve timing control apparatus further includes an integral control section for integrating a deviation between the target valve timing and the actual valve timing to provide an integral correction value for correcting the control amount calculated by the control amount calculating section. The integral correction value is corrected to the control amount calculated by the control amount calculating section, and when the target valve timing changes from the outside of the control range into the control range, the integral correction value is initialized.

The above and other objects, features and advantages of the present invention will become more readily apparent to those skilled in the art from the following detailed description of preferred embodiments of the present invention taken in conjunction with the accompanying drawings.

DESCRIPTION OF THE PREFERRED EMBODIMENTS

Now, preferred embodiments of the present invention will be described in detail referring to the accompanying drawings.

Embodiment 1

Figure 1:
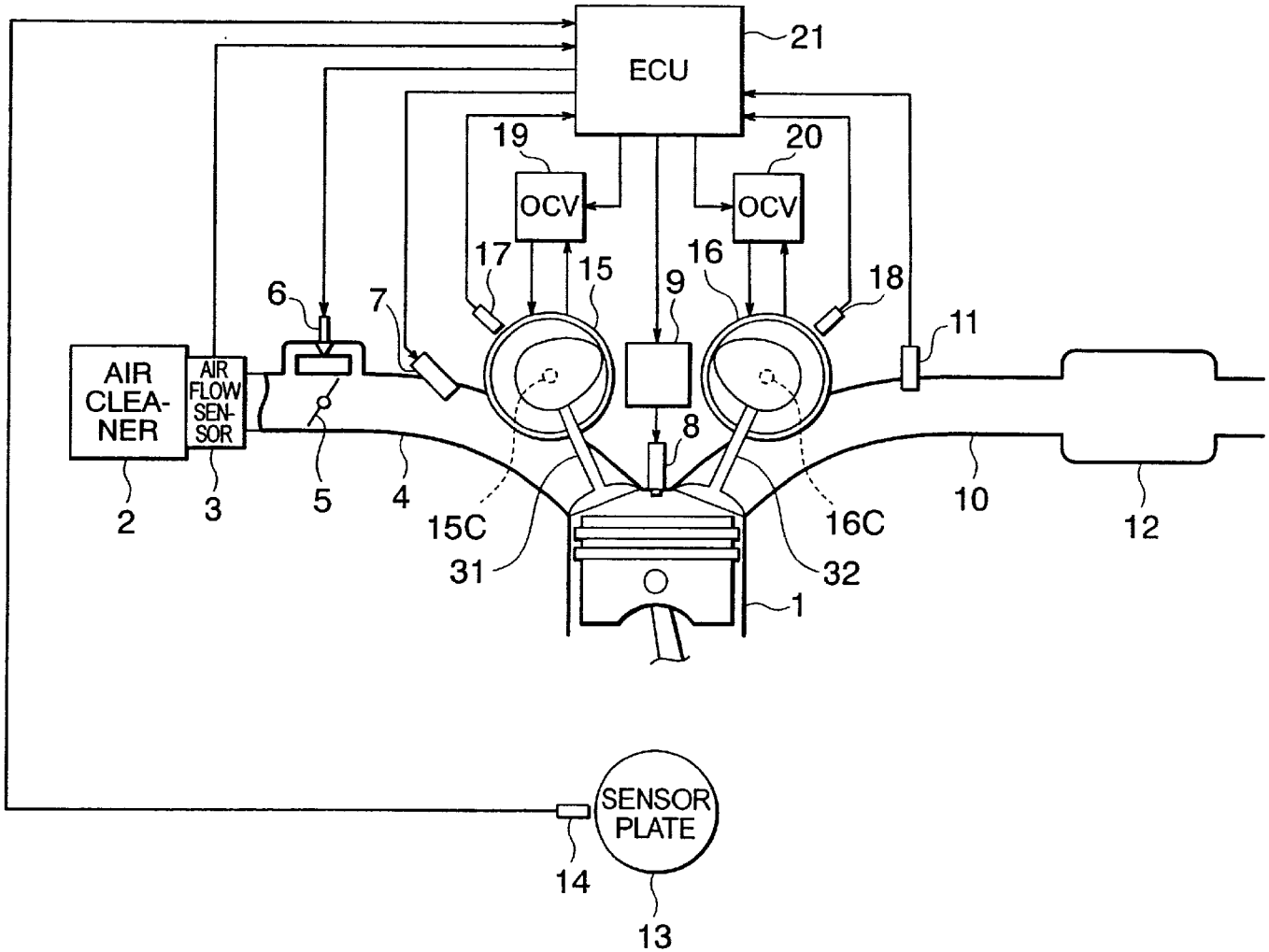
FIG. 1 is a block diagram illustrating a valve timing control apparatus of an internal combustion engine according to the present invention.

FIG. 1 illustrates the configuration of a valve timing control apparatus for an internal combustion engine according to one embodiment of the present invention in association with peripheral portions of the internal combustion engine. A reference numeral 1 designates an internal combustion engine for a vehicle such as a motor car. An air cleaner 2 is connected with an intake pipe 4 of the internal combustion engine 1 for cleaning air sucked therein. An airflow sensor 3 meters the amount of air sucked into the internal combustion engine 1. A throttle valve 5 adjusts the amount of air sucked into the internal combustion engine 1 thereby to control the output power of the internal combustion engine 1. An idle speed control valve 6 is operated to permit the air flowing through the intake pipe 4 while bypassing the throttle valve 5 (hereinafter simply referred to as ISCV) so as to perform control on the number of revolutions per unit time of the engine and the like.

An injector 7 supplies the amount of fuel corresponding to the amount of sucked air to the intake pipe 4. A spark plug 8 generates a spark to fire an air-fuel mixture in a combustion chamber in each cylinder of the internal combustion engine 1. An ignition coil 9 supplies high voltage energy to the spark plug 8.

An exhaust pipe 10 is connected with the internal combustion engine 1 for discharging exhaust gases from the combustion chamber in each cylinder to the atmosphere. An oxygen sensor 11 is mounted on the exhaust pipe 10 for detecting the amount of residual oxygen in the exhaust gases. A catalytic converter 12 containing a three way catalyst is connected with the exhaust pipe 10 for purifying the exhaust gases, in particular HC, CO and NOx together which are harmful gases contained in the exhaust gases, flowing in the exhaust pipe 10.

A sensor plate 13 having crank angle detecting projections (not shown) on the outer periphery thereof at predetermined locations is connected with the crankshaft of the engine for rotation therewith. A crank angle sensor 14 detects the crank angle or rotational position of the crankshaft. Whenever each projection of the sensor plate 13 crosses the crank angle sensor 14, the crank angle sensor 14 generates a signal in the form of a pulse representative of the crank angle of the crankshaft.

Actuators 15 and 16 each serve to shift the cam angle of a corresponding valve operating cam and hence a corresponding camshaft 15C or 16C relative to the crank angle of the crankshaft. The valve operating cams are mounted on the camshafts 15C and 16C, respectively, for integral rotation therewith. Cam angle sensors 17 and 18 each generate a pulse signal representative of the cam angle or rotational position of a corresponding camshaft 15C or 16C whenever each projection of a cam angle sensor plate (not shown), which is mounted on a corresponding one of the camshafts 15C and 16C for rotation therewith, crosses a corresponding one of the cam angle sensors, as in the case of the crank angle sensor 14.

Oil control valves (OCVs) 19 and 20 cooperate with an unillustrated oil pump to constitute a hydraulic pressure supply system for hydraulically controlling the actuators 15 and 16 to adjust the rotational phases or positions of the valve operating cams or camshafts 15C and 16C relative to the rotational phase or position of the crankshaft. These OCVs 19 and 20 serve to regulate or switch the hydraulic oil pressure supplied to the cam phase variable actuators 15 and 16 thereby to control the phases of the cams on the camshafts 15C and 16C.

An electronic control unit (ECU) 21 is in the form of a computer, and constitutes a control unit for controlling the operation of the internal combustion engine 1. The ECU 21 receives the output signals from the various sensors 3, 11, 14, 17 and 18, and controls the injector 7 and the spark plug 8 as well as the cam angle phases of the camshafts 15C and 16C in accordance with the engine operating conditions detected by the sensors 3, 11, 14, 17 and 18.

The intake valve and the exhaust valve 31 and 32 is driven by the cams connected with the camshafts 15C and 16C, respectively, in synchronization with the rotation of the crankshaft to open and close the intake port and the exhaust port of the combustion chamber defined in each cylinder of the internal combustion engine 1.

Here, note that the airflow sensor 3, the oxygen sensor 11 and the crank angle sensor 14 together constitute an engine operating condition detection section. The actuators 15 and 16 constitute a variable valve timing mechanism. The crank angle sensor 14 and the cam angle sensors 17 and 18 together constitute an actual valve timing detection section. The OCVs 19 and 20 constitute an actual valve timing control section. The ECU 21 constitutes a target valve timing calculation section, a control amount calculation section, a holding control amount learning section and an integral control section.

First of all, reference will be made to the control of the internal combustion engine 1 prior to describing the cam phase angle control. The airflow sensor 3 measures the amount of air sucked into the internal combustion engine 1. The ECU 21 calculates the amount of fuel corresponding to the amount of air thus measured, and drives the injector 7 for a period of time corresponding to the amount of fuel thus calculated. At the same time, the ECU 21 controls a current supply time for which current is supplied to the ignition coil 9 and the timing of cutting off the current supply in order to ignite an air fuel mixture in the combustion chamber in each cylinder by means of the spark plug 8 at appropriate timing.

The amount of air sucked into the internal combustion engine 1 is adjusted by means of the throttle valve 5 to control the output power to be generated by the internal combustion engine 1. The air fuel mixture in each engine cylinder is combusted to generate exhaust gases which are discharged through the exhaust pipe 10 to the external atmosphere. The exhaust gases passing through the exhaust pipe 10 are purified by means of the catalyst in the catalytic converter 12 inserted in the exhaust pipe 10. That is, harmful substances such as HC, CO and NOx contained in the exhaust gases are changed into harmless substances of $CO_2$ and $H_2O$ through chemical reactions in the catalytic converter 12. In order to draw out the purification efficiency in the catalytic converter 12 to its maximum extent, the oxygen sensor 11 installed on the exhaust pipe 10 detects the amount of residual oxygen in the exhaust gases so that the ECU 21 can adjust the amount of fuel injected from the fuel injector 7 into the intake pipe 4 in a feedback manner so as to control the air to fuel ratio of the mixture to a stoichiometric ratio.

The internal combustion engine 1 intrinsically has different valve timing required for opening and closing the intake and exhaust valves 31 and 32 in accordance with engine operating conditions. However, since in most internal combustion engines developed in the past, the camshafts are driven to rotate by means of the crankshaft through timing belts, timing chains or the like, the opening and closing timings of the intake and exhaust valves are fixed with respect to the crank angle or rotational position of the crankshaft. However, in recent years, a variable valve timing system has come to be adopted for the purposes of increasing engine output power, decreasing harmful components in the emissions and improving fuel economy.

Thus, the operation of such a variable valve timing system will be explained below. In an internal combustion engine with fixed valve opening and closing timing, the rotation of the crankshaft is transmitted through timing belts, timing chains or the like to pulleys, sprockets or the like fixedly mounted on the camshafts 15C and 16C for integral rotation therewith. In contrast, in the variable valve timing system employed by the present invention, the actuators 15 and 16 in place of such pulleys, sprockets or the like are mounted on the camshafts 15C and 16C, respectively, for variably changing the relative positions of the crankshaft and the camshafts to enable variable control on the valve opening and closing timing.

Figure 2:
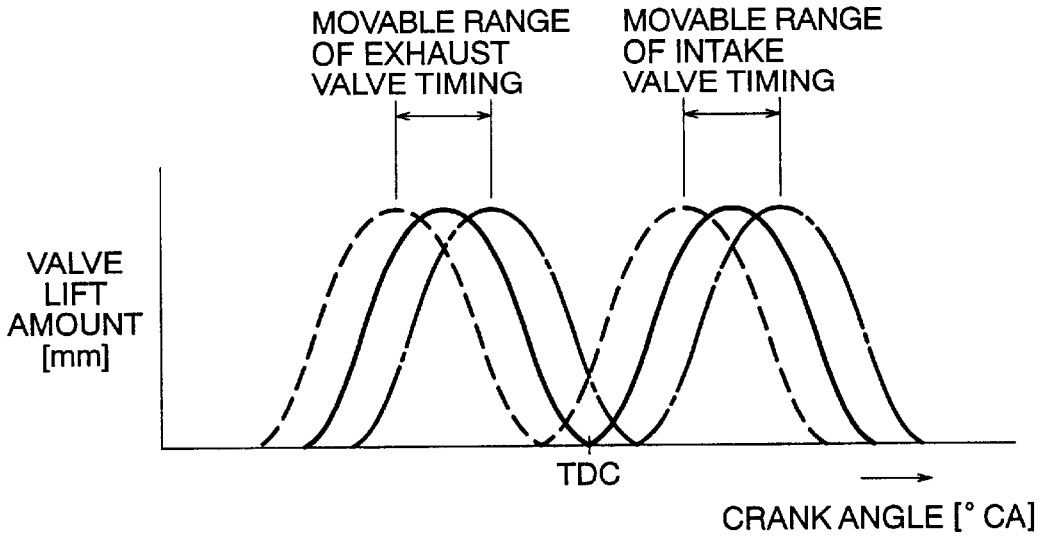
FIG. 2 is an explanatory view illustrating a phase shift range represented by the relation of the amount of valve lift to the crank angle position according to a generally known valve timing control apparatus for an internal combustion engine.

FIG. 2 is an explanatory view illustrating a phase variable or shiftable range of each actuator according to the valve timing control apparatus, represented by the relation of the amount of valve lift [mm] (i.e., the amount of valve opening) to the phase position of the crank angle [° CA]. The valve opening and closing timings for the intake valve and the exhaust valve are variable from a broken line curve to an alternate long and short dash line curve in FIG. 2. A solid line curve represents the valve opening and closing timings with each actuator being locked by a lock mechanism to stop relative motion between the crankshaft and each camshaft. The alternate long and short dash line curve represents a maximum retarded angle position of each actuator at which the rotational motion of each camshaft relative to the crankshaft in an angle retarding direction is mechanically stopped. A broken line represents a maximum advanced angle position of each actuator at which the rotational motion of each camshaft relative to the crankshaft in an angle advancing direction is mechanically stopped. Here, note that the term "advancing the valve timing" means that the start of opening the intake valve 31 and the exhaust valve 32 is shifted earlier with respect to the crank angle. On the contrary, the term "retarding the valve timing" means that the start of opening the intake valve 31 and the exhaust valve 32 is shifted later with respect to the crank angle. The valve timing can be controlled at any arbitrary position within this phase variable or shiftable change.

Figure 4:
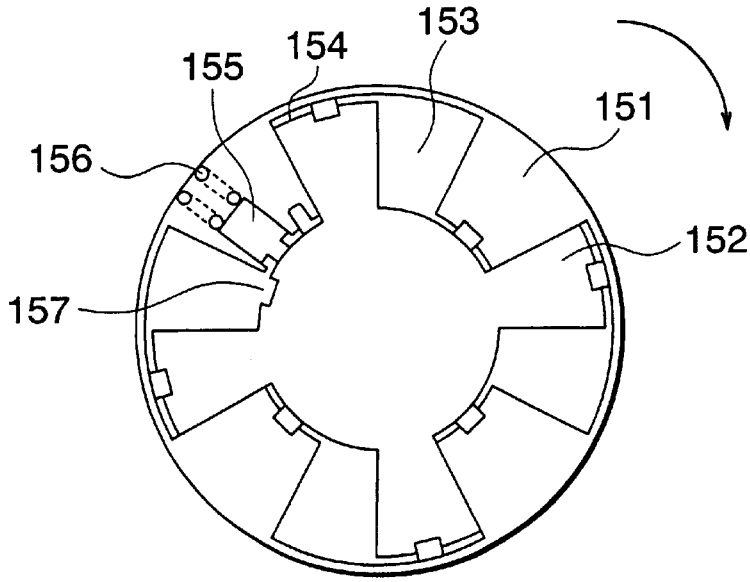
FIG. 4 is a perspective view illustrating the internal structure of a general actuator at its maximum retarded angle position.
Figure 5:
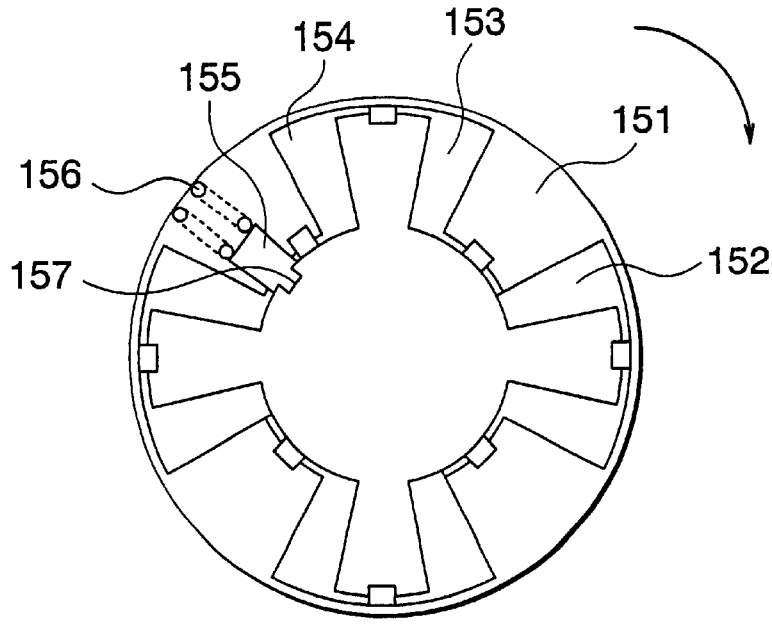
FIG. 5 is a perspective view illustrating the internal structure of the general actuator at its locked position.
Figure 6:
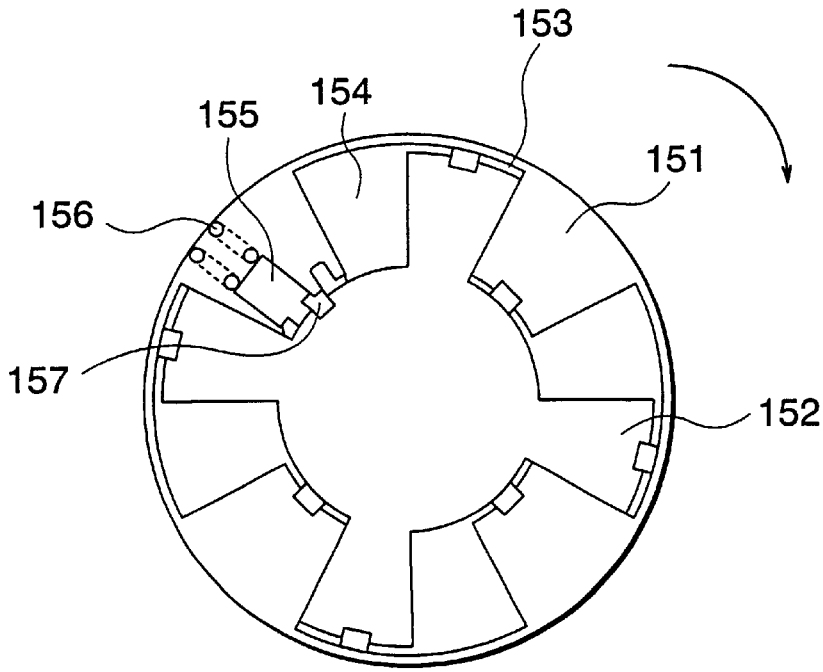
FIG. 6 is a perspective view illustrating the internal structure of the general actuator at its maximum advanced angle position.

In addition, FIGS. 4 through 6 are the perspective views which illustrate the internal structure of each of the valve actuators 15 and 16 at their maximum retarded angle position, their locked position and their maximum advanced angle position, respectively, with a variable valve timing mechanism (hereinafter, simply referred to as a VVT mechanism) being attached thereto for individually changing the respective valve timings for the intake and exhaust valves.

The actuators 15 and 16 serve to change the valve timing. Each of the actuators 15 and 16 includes a cylindrical housing 151, a vane member having a plurality of vanes 152 received in the housing 151, a pair of angle retarding hydraulic chamber 153 and angle advancing hydraulic chamber 154 defined on the opposite sides of each vane 152 in the housing 151, a lock pin 155 for locking the vane member against the housing 151 to stop relative rotation therebetween, an urging member in the form of a spring 156 for urging the lock pin 155 in a direction to engage a later-mentioned lock recess 157, and the lock pin 157 formed in the vane member for fitting engagement with the lock pin 155.

A driving force is transmitted from the crankshaft to the housing 151 through the intermediary of a belt and pulley mechanism (not shown) so that the housing 151 is driven to rotate in a direction indicated at an arrow at a rotational speed equal to a half of the rotational speed of the crankshaft. The driving force transmitted to the housing 151 is further transmitted to the vanes 152 through hydraulic operating fluid in the form of engine oil filled in the angle retarding hydraulic chamber 153 or the angle advancing hydraulic chamber 154 or through abutting engagement of the vanes 152 with the housing 151. The vane member with the plurality of vanes 152 is fixedly connected with the corresponding camshaft 15C or 16C for integral rotation therewith. Thus, the actuators 15 and 16 are driven to operate by the engine oil.

FIG. 4 illustrates the state of the vanes 152 located at the maximum retarded angle position, which is a position corresponding to the alternate long and short dash line of FIG. 2. FIG. 6 illustrates the state of the vanes 152 located at the maximum advanced angle position, which is a position corresponding to the broken line of FIG. 2. FIG. 5 shows a lock position where the vanes 152 are locked to the housing 151 by means of the lock pin 155 engaged with the lock recess 157 in the lock member, the lock position being a position corresponding to the solid line of FIG. 2. Such position control is carried out by controlling the hydraulic operating fluid supplied to each of the actuator 15 and 16. To place the vanes 152 at the maximum retarded angle position of FIG. 4, the OCV 19 or 20 is controlled such that the hydraulic operating fluid is supplied to the angle retarding chamber 153. On the other hand, to place the vanes 152 at the maximum advanced angle position of FIG. 6, the OCV 19 or 20 is controlled to supply the hydraulic operating fluid to the angle advancing chamber 154. Thus, by selectively supplying the hydraulic operating fluid to the angle retarding chamber 153 or the angle advancing chamber 154, the phase or angle position of the vanes 152 can be shifted in the housing 151.

More specifically, the angle retarding chamber 153 and the angle advancing chamber 154 serve to determine the operating range of the vanes 152. The lock recess 157 is provided at a prescribed lock position of the vanes 152 in a manner as to oppose a tip end of the lock pin 155. The spring 156 urges the lock pin 155 in the direction to engage the lock recess 157.

Here, note that an oil feed port (not shown) is provided in fluid communication with the lock recess 157, so that the angle retarding chamber 153 and the angle advancing chamber 154 are selectively switched to supply the hydraulic operating fluid from either one thereof with higher oil pressure to the lock recess 157.

The vanes 152 movable to shift their phase within the angle retarding chamber 153 and the angle advancing chamber 154 (i.e., within the operating range) are fixedly secured to the camshaft 15C or 16C which drives the corresponding intake valve 31 or the exhaust valve 32. Moreover, though not illustrated, the exhaust valve side actuator 16 is provided with a spring for urging the vanes 152 in an angle advancing direction in order to offset a reactive force of the camshaft 16C.

The actuators 15 and 16 are operated by lubricating oil (hydraulic oil pressure) of the internal combustion engine 1 supplied from the OCVs 19 and 20. To control the cam angle phase of the actuator 15 or 16 as shown in FIGS. 4 through 6, the amount of hydraulic operating fluid (hydraulic oil pressure) flowing into the actuator 15 or 16 is controlled.

The hydraulic operating fluid is supplied to the angle retarding chamber 153 to adjust the cam angle phase to the maximum retarded angle position, as shown in FIG. 4. On the contrary, the hydraulic operating fluid is supplied to the angle advancing chamber 154 to adjust the cam angle phase to the maximum advanced angle position, as shown in FIG. 6.

Figure 7:
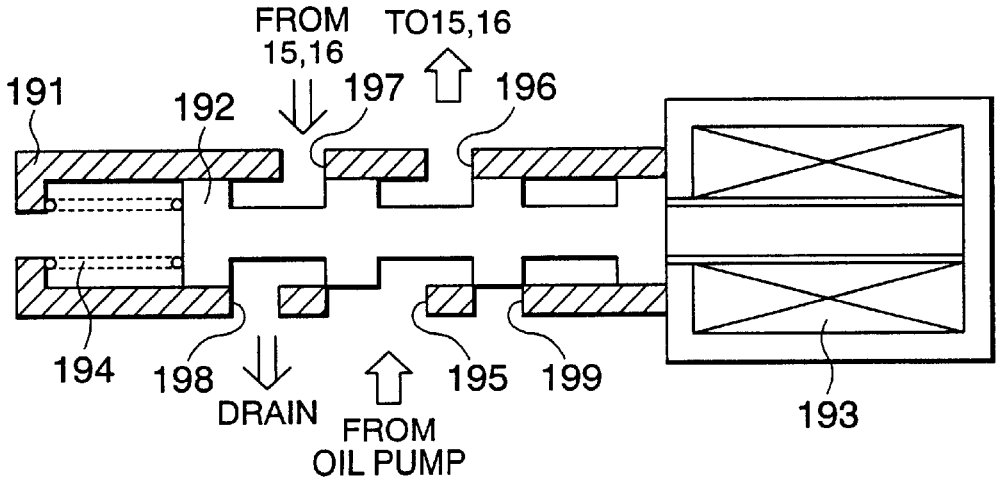
FIG. 7 is a cross sectional side view illustrating the internal structure of a general OCV in its minimum control state.
Figure 8:
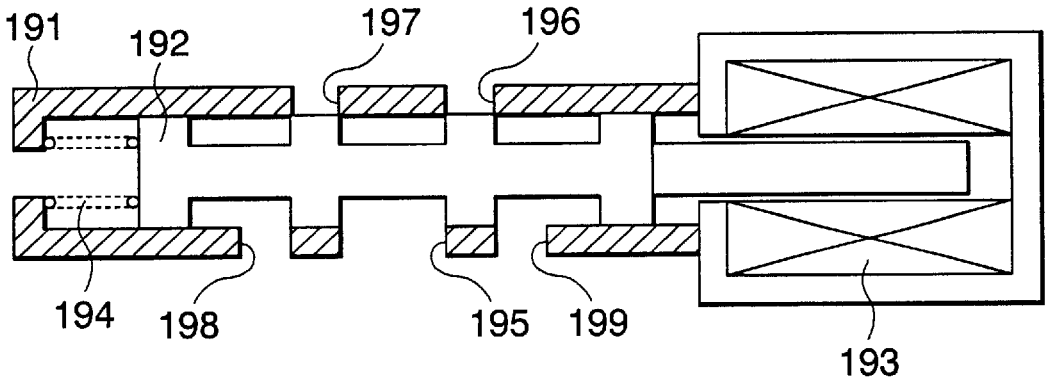
FIG. 8 is a cross sectional side view illustrating the internal structure of the general OCV in its intermediate control state.
Figure 9:
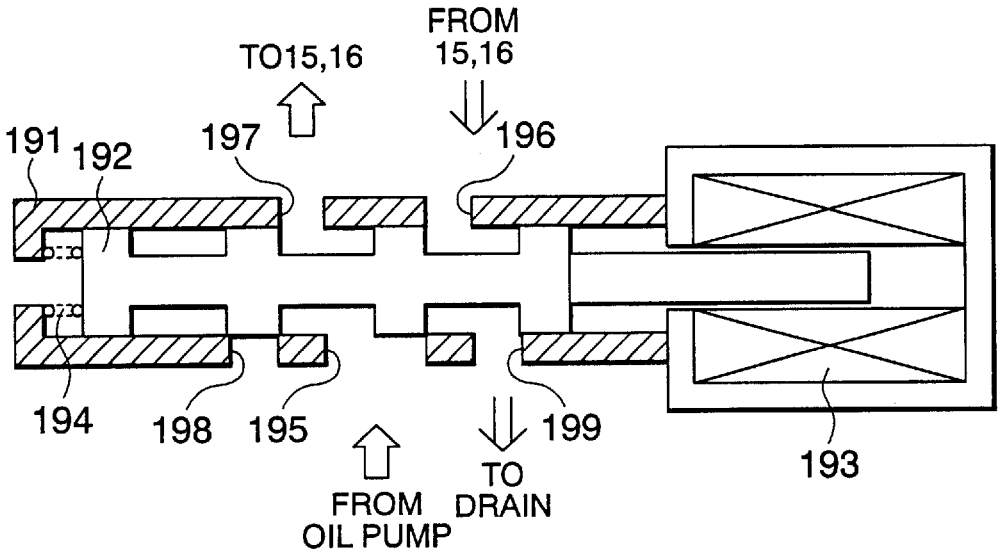
FIG. 9 is a cross sectional side view illustrating the internal structure of the general OCV in its maximum control state.

The OCVs 19 and 20 serve to control whether the hydraulic operating fluid is supplied to the angle retarding chamber 153 or the angle advancing chamber 154. FIGS. 7 through 9 are cross sectional side views illustrating the internal structure of the OCV (hydraulic pressure supply system) 19 or 20. Each of the OCVs 19 and 20 includes a housing 191 of a cylindrical shape in which a spool 192 is slidably accommodated. An electromagnetic coil 193 when energized serves to continuously drive the spool 192 in an operating direction, i.e., to the left in FIGS. 7 through 9, against an urging force of a spring 194, which acts to urge the spool 192 in a returning direction thereof, i.e., to the right in these figures.

FIG. 7 illustrates the case where the current energizing the electromagnetic coil 193 is of a minimum value. In this case, the hydraulic operating fluid from the pump flows into the angle retarding chamber 153 of the intake valve side actuator 15, whereas the hydraulic operating fluid in the angle advancing chamber 154 thereof flows out into an unillustrated oil pan. In the case of the exhaust valve side actuator 16, the operation is the opposite of the intake valve side actuator 15. That is, the hydraulic operating fluid from the pump flows in the angle advancing chamber 154 of the actuator 16, whereas the hydraulic operating fluid in the angle retarding chamber 153 thereof flows out into the oil pan. The oil path arrangement is such that if no current is supplied to the OCVs 19 and 20 due to electric disconnections, broken wires or the like both on intake stroke and exhaust stroke, the valve overlap (i.e., overlap of the opening period of the intake valve 31 and the opening period of the exhaust valve 32) is minimized for improved resistance to engine stall.

The condition of the OCV 19 or 20 as shown in FIG. 9 is the one in which a maximum current is supplied to the electromagnetic coil 193. During intake strokes, the hydraulic operating fluid from the pump flows into the angle advancing chamber 154 of the actuator, whereas the hydraulic operating fluid in the angle retarding chamber 153 thereof is drained to the oil pan. On the contrary, during exhaust strokes, the hydraulic operating fluid from the pump flows into the angle retarding chamber 153 of the actuator, whereas the hydraulic operating fluid in the angle advancing chamber 154 thereof is drained to the oil pan.

In the lock recess 157 of the actuator, there is formed an unillustrated oil supply port through which hydraulic operating fluid is supplied to the lock recess 157 through switching from one of the angle retarding chamber 153 and the angle advancing chamber 154 which is higher in pressure than the other. When pressure oil in the lock recess 157 being supplied thereto from the oil supply port in the operating state of FIG. 5 reaches an oil pressure overcoming the urging force of the spring 156, the lock pin 155 is pushed out from the lock recess 157 under the action of the pressure oil in the lock recess 157, so that the vanes 152 become operable to rotate relative to the housing 151.

Stated in a little more detail, the housing 191 has an orifice 195 in fluid communication with the unillustrated pump, orifices 196 and 197 in fluid communication with the actuator 15 or 16, and drain orifices 198 and 199 in fluid communication with the unillustrated oil pan.

The orifice 196 leads to the angle retarding chamber 153 of the actuator 15 or the angle advancing chamber 154 of the actuator 16. The orifice 197 leads to the angle advancing chamber 154 of the actuator 15 or the angle retarding chamber 153 of the actuator 16.

The orifices 196 and 197 are selectively placed into fluid communication with the oil supply orifice 195 in accordance with the axial position of the spool 192 in the housing 191. The orifice 195 leads to the orifice 196 in FIG. 7, but to the orifice 197 in FIG. 9.

Similarly, the drain orifices 198 and 199 are selectively placed into fluid communication with the orifice 197 or 196 in accordance with the axial position of the spool 192. In FIG. 7, the orifice 197 and the orifice 198 are in fluid communication with each other, but in FIG. 9, the orifice 196 and the orifice 199 are in fluid communication with each other.

The oil conduits are arranged such that the oil supply port in the recess 157 is supplied with hydraulic operating fluid or oil from either one of the angle retarding chamber 153 and the angle advancing chamber 154 that is higher in hydraulic pressure than the other. When the hydraulic pressure in the lock recess 157 exceeds the urging force of the spring 156, the lock pin 155 is pushed out of the lock recess 157 to release the locked state of the vanes 152.

FIG. 7 illustrates the case where the current energizing the electromagnetic coil 193 is of a minimum value, with the spring 194 being expanded to its maximum. In the case the OCV shown in FIG. 7 is the intake valve side OCV 19, the hydraulic operating fluid supplied from the pump through the orifice 195 flows into the angle retarding chamber 153 of the actuator 15 through the orifice 196. As a result, the actuator 15 is placed into the state illustrated in FIG. 4.

Consequently, the hydraulic operating fluid in the angle advancing chamber 154 of the actuator 15 is drained to the OCV 19 through the orifice 197, and thence to the oil pan through the orifice 198.

On the other hand, in the case the OCV shown in FIG. 7 is the exhaust valve side OCV 20, the operation is the opposite of the intake valve side OCV 19. That is, the hydraulic operating fluid supplied from the pump flows into the angle advancing chamber 154 of the actuator 16 through the orifice 196. As a result, the actuator 16 is placed into the state illustrated in FIG. 6.

At this time, the hydraulic operating fluid in the angle retarding chamber 153 of the actuator 16 is drained to the oil pan through the orifices 197 and 198.

FIG. 9 illustrates the case wherein the current energizing the electromagnetic coil 193 is of a maximum value, with the spring 194 being compressed to its minimum. For instance, in the case the OCV of FIG. 9 is the intake valve side OCV 19, the hydraulic operating fluid supplied from the pump flows into the angle advancing chamber 154 of the actuator 15 through the orifice 197, and the hydraulic operating fluid in the angle retarding chamber 153 of the actuator 15 is drained through the orifices 196 and 199.

On the other hand, in the case the OCV of FIG. 9 is the exhaust valve side OCV 20, the hydraulic operating fluid supplied from the pump flows into the angle retarding chamber 153 of the actuator 16 through the orifice 197, and the hydraulic operating fluid in the angle advancing chamber 154 of the actuator 16 is drained through the orifices 196 and 199.

FIG. 8 illustrates the state of the OVC in which the spool 192 is controlled at a valve timing control ending position or an arbitrary position between the maximum advanced angle and the maximum retarded angle. At this time, the vanes 152 of each of the actuators 15 and 16 are at an arbitrary target position (including the locked position).

Here, note that in the state of FIG. 8, the oil supply side orifice 195 is not directly in fluid communication with the actuator side orifice 196 or 197, but the leaked hydraulic operating fluid is able to be supplied to the oil supply port of the lock recess 157 (see FIG. 5).

Accordingly, when the hydraulic oil pressure of the leaked hydraulic operating fluid at the oil supply port reaches a hydraulic oil pressure (i.e., a prescribed hydraulic oil pressure for unlocking) overcoming the urging force of the spring 156, even if the vanes 152 are at their lock position for instance, the lock pin 155 is disengaged from the lock recess 157 to place the vanes 152 in a state operable to move in the housing 151.

Here, note that the prescribed hydraulic oil pressure for unlocking can be set to an arbitrary minimum value as required through adjustment of the urging force of the spring 156, etc. In addition, the position or phase of the vanes 152 of each actuator 15 or 16 for determining the valve timing is able to be detected by the corresponding cam angle sensor 17 or 18, and hence controlled arbitrarily.

Figure 3:
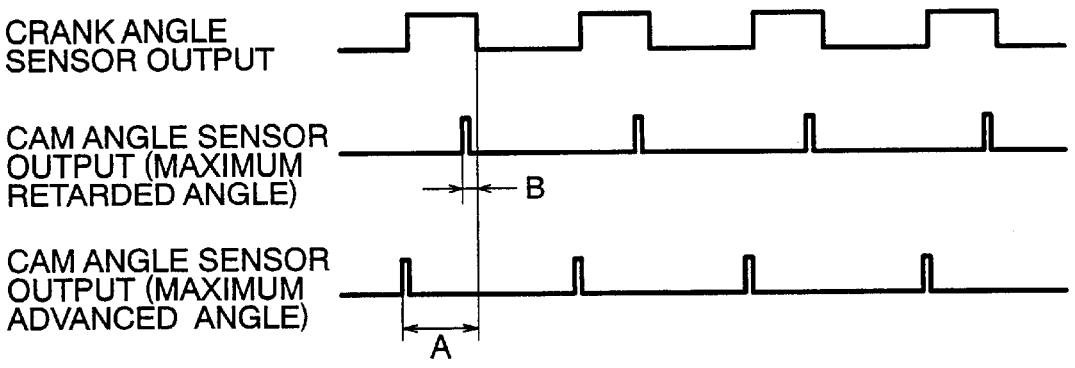
FIG. 3 is a timing chart illustrating the phase relation between the output pulse of a general crank angle sensor and the output pulse of a general cam angle sensor.

FIG. 3 illustrates the positional relation between the outputs of the crank angle sensor and each cam angle sensor. The cam angle sensors 17 and 18 are installed at the positions where the relative positions of the corresponding camshafts 15C and 16C being shifted against the crankshaft can be detected. In FIG. 3, a difference between the output of each cam angle sensor at the maximum retarded angle position of the valve timing, as indicated by the alternate long and short dash line in FIG. 2, and the output of the crank angle sensor is represented by a symbol B, and a difference between the output of each cam angle sensor at the maximum advanced angle position of the valve timing, as indicated by the broken line in FIG. 2, and the output of the crank angle sensor is represented by a symbol A.

The ECU 21 performs the valve timing control at an arbitrary position in a feedback manner so that the detected phase differences A and B are made to match the target values. For instance, when the rotational position or phase of the camshaft 15C or 16C relative to that of the crankshaft detected by the corresponding cam angle sensor and the crank angle sensor exist on the retarded angle side from the target rotational position or phase thereof calculated by the ECU 21, the amount or magnitude of current to be supplied to the electromagnetic coil 193 of the OCV is controlled according to a deviation between the detected position and the target position of the camshaft so as to advance the detected position to the target position.

When a difference between the target position and the detected position is great (i.e., greater than a predetermined value), to make the detected position follow the target position swiftly, the amount of current supplied to the electromagnetic coil 193 of the OCV is increased so that the effective sectional area of the oil conduit leading to the angle advancing chamber 154 of each actuator is enlarged to increase the amount of hydraulic operating oil. As the detected position approaches the target position, the amount of current supplied to the electromagnetic coil 193 is decreased so that the position of the spool of the OCV approaches the state of FIG. 8. When the detected position matches the target position, each actuator is controlled such that the oil conduits leading to the angle retarding chamber 153 and the angle advancing chamber 154 of the actuator are shut off as illustrated in FIG. 8.

The target position in the normal engine operating conditions such as the running condition after warming up of the internal combustion engine may be determined, for example, by the use of a two-dimensional target position map comprising the number of revolutions per unit time of the engine and the engine load, such a map being stored in advance in a ROM of the ECU 21. Thus, by setting the target position in accordance with the engine operating conditions, the valve timing can be controlled optimally for the respective engine operating conditions.

Since the oil pump is driven by the engine, the number of revolutions per unit time of the oil pump during engine starting is not enough (i.e., not sufficiently high) and hence the amount of hydraulic operating oil supplied to the actuators is insufficient, as a consequence of which it is impossible to control the advanced angle position of each actuator by means of the hydraulic oil pressure of the oil pump. Therefore, by engaging the lock pin 155 into the lock recess 157 as illustrated in FIG. 5, it is possible to prevent fluctuations of the vanes 152 due to the insufficient hydraulic oil pressure.

At the time of engine starting, there is suitable valve timing for starting the engine, so the engaging position of the lock pin 155 with the lock recess 157 is set to be suitable for the valve timing for engine starting. When the opening and closing timing of the intake valve 31 are too advanced during engine starting, the valve overlap increases excessively, whereas when the opening and closing timing of the intake valve 31 during engine starting is too retarded, the actual compression ratio decreases excessively. In any case, the number of revolutions per unit time of the engine during engine cranking rises due to a reduction in the pumping loss. Therefore, it is advantageous for generation of a first explosion, but the subsequent combustion is unsatisfactory and hence there is a possibility that complete explosion can not be reached.

On the other hand, when the opening and closing timing of the exhaust valve 32 is too advanced, the actual expansion ratio becomes excessively short, and hence the combustion energy can not be transmitted to the crankshaft to any satisfactory extent. In addition, retarding the valve timing of the exhaust valve 32 increases the valve overlap, thus resulting in the same situation as in the case of the intake valve 31 being too advanced. Thus, at the time of engine starting and immediately thereafter, whether the valve timing is too advanced or retarded, startability of the engine is deteriorated or the engine can not be started. Therefore, upon engine starting and immediately thereafter, the vanes 152 are locked to the housing 151 by means of the lock pin 155 in order to provide good valve timing.

After the engine has been started, the oil pressure produced by the oil pump rises in accordance with the increasing engine rotational speed so that pressure oil is supplied to the actuators. As the pressure oil is supplied to the actuators, hydraulic oil pressure is also supplied to the lock recess 157. When the hydraulic oil pressure in the lock recess 157 overcomes the urging force of the spring 156, the lock pin 155 is caused to disengage from the lock recess 157 to permit the vanes 152 to move or rotate relative to the housing 151. As a result, by controlling the OCVs 19 and 20, the supply of hydraulic oil pressure to the angle retarding chamber 153 and the angle advancing chamber 154 is controlled, thus making it possible to adjust the valve timing in an advancing or retarding direction.

In the cold engine state after the engine having been started, the vanes 152 are controlled to an advanced angle position for the purpose of raising the temperature of the catalyst in the catalytic converter 12. Therefore, it is necessary to release the lock pin 155 from the lock recess 157. The engine lubricating oil is used as hydraulic fluid for operating the actuators as well as for locking and unlocking the lock pin 155. The pressure of the engine lubricating oil changes depending upon the number of revolutions per unit time of the engine and the temperature of the engine lubricating oil. When ignition timing advancing control is effected in a cold idle state of the engine, it is at least necessary to generate the hydraulic oil pressure sufficient for unlocking the lock pin 155.

After the ignition timing advancing control under the engine cold idle state has been finished, in order to control the vanes 152 in the vicinity of the locked position of the lock pin 155, the hydraulic oil pressure capable of releasing or unlocking the lock pin 155 may be maintained to perform the feedback control of the vanes 152 in the vicinity of the locked position. Otherwise, the vanes 152 may be locked against the housing 151 by means of the lock pin 155 at their locked position. In this case, the rotational speed of the engine increases immediately when the driver depresses the accelerator pedal to run the vehicle, so that the hydraulic oil pressure of the oil pump rises, thereby releasing the locking of the lock pin 155. As a consequence, it becomes possible to perform engine control at an advanced or retarded angle position in addition to the locked position in accordance with the engine operating conditions.

Next, reference will be made to a specific control operation according to this first embodiment while using a flow chart of FIG. 10. The processing shown in this flow chart is executed at predetermined timing or intervals in the ECU 21. Here, changing the intake valve timing will be described, but the processing of this flow chart may be used for controlling the exhaust valve timing. In this case, however, the advanced angle and the retarded angle of the intake valve is reversed for the exhaust valve. That is, a small control amount represents an advanced angle, and a large control amount represents a retarded angle.

First, in step 1001, a difference in rotational position or phase between the outputs of the crank angle sensor 14 and the cam angle sensor 17 is calculated in terms of an angle. In addition, a difference in rotational position or phase between the outputs of the crank angle sensor 14 and the cam angle sensor 17 at a mechanical stop position of the vanes 152 (i.e., at the maximum retarded angle position or at the maximum advanced angle position) is set as a reference position, and a deviation of the difference in rotational position or angle calculated above from the reference position is defined as an actual advanced angle amount VTd.

In step 1002, an optimal target advanced angle amount VTt suitable for the engine operating conditions is calculated. For instance, the calculation of the target advanced angle amount VTt is carried out as follows. That is, a two-dimensional map for interpolation reference based on the charging efficiency and the number of revolutions per unit time of the engine is stored in advance in a ROM (not shown specifically) of the ECU 21, and the ECU 21 reads out the target advanced angle amount VTt from this map. The target advanced angle amounts for optimizing the fuel cost, exhaust gases, engine output power, etc., under various engine operating conditions are set as map values in advance through experiments or the like.

In step 1003, an actual advanced angle VTd is subtracted from the target advanced angle amount VTt to provide a control deviation VTe. In step 1004, the control deviation VTe is multiplied by a proportional gain Pgain to provide a proportional value Ip. The proportional gain Pgain is preset to a value for optimizing response for the actual advanced angle amount VTd.

In step 1005, the last control deviation VTe(i−1) is subtracted from the current control deviation VTe, and the result of this calculation is multiplied by a derivative gain Dgain to provide a derivative value Id. The derivative gain Dgain is also preset to a value for optimizing response for the actual advanced angle amount VTd.

Figure 11:
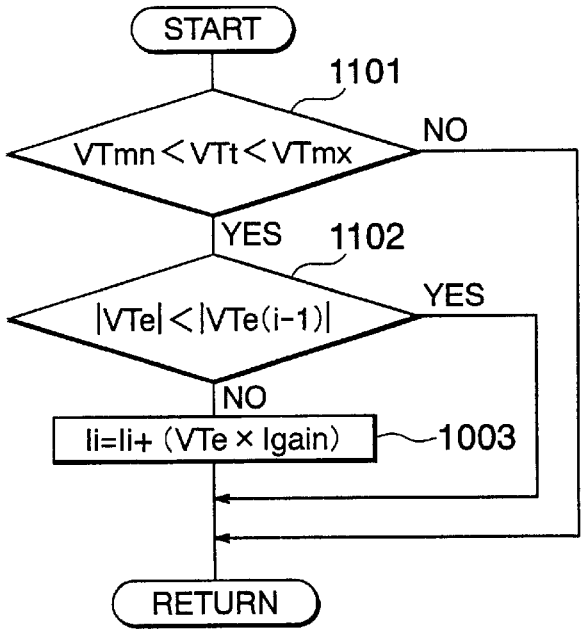
FIG. 11 is a flow chart illustrating how to calculate an integral value Ii in the valve timing control apparatus for an internal combustion engine according to one embodiment of the present invention.

In step 1006, an integral value Ii is calculated according to a flow chart shown in FIG. 11. In step 1101, a determination is made whether the target advanced angle amount VTt is within a prescribed range between a minimum deviation control value VTmn and a maximum deviation control value VTmx. For instance, in case where a movable range of the valve timing is from 0 to 60 [degCA] (degrees in crank angle), the minimum deviation control value VTmn is set to 3 [degCA], and the maximum deviation control value VTmx is set to 57 [degCA].

When it is determined that the target advanced angle amount VTt is within the prescribed range, then in step 1102, it is determined whether the absolute value |VTe| of the control deviation is less than the absolute value |VTe(i−1)| of the last control deviation. That is, a determination is made whether the actual advanced angle amount VTd is moving toward the target advanced angle amount VTt. When the actual advanced angle amount VTd is not moving toward the target advanced angle amount VTt, then in step 1103, the result of multiplication of the control deviation VTe and the integral gain Igain is added to the last integral value Ii to provide an new or current integral value Ii.

Returning to FIG. 10, in step 1007, it is determined whether the target advanced angle amount VTt is greater than the maximum deviation control value VTmx, and then in step 1008, it is further determined whether the target advanced angle amount VTt is less than the minimum deviation control value VTmn. When the answers to the questions in steps 1007 and 1008 are both "NO", then in step 1013, a determination is made whether the absolute value |VTe| of the control deviation is greater than the control switching reference value VTh. When the absolute value |VTe| of the control deviation is greater than the control switching reference value VTh, then in step 1014, the holding current learned value Ih, proportional value Ip, derivative value Id and integral value Ii are added together to provide an output current value Iout. On the other hand, if the absolute value |VTe| of the control deviation is equal to or less than the control switching reference value VTh, then in step 1015, the holding current learned value Ih and the integral value Ii are added to each other to provide an output current value Iout. The control switching reference value VTh is about 1 [degCA] for instance so that there will be no adverse influence on the engine operation even if the actual advanced angle amount VTd changes.

Figure 12:
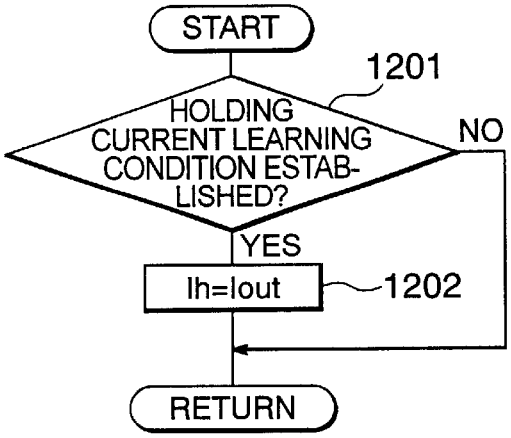
FIG. 12 is a flow chart illustrating how to learn a holding current learned value Ih in the valve timing control apparatus of for an internal combustion engine according to one embodiment of the present invention.

The holding current learned value Ih is learned according to the processing shown in a flow chart of FIG. 12. First, in step 1201, it is determined whether the holding current learning condition is established. For instance, if the actual advanced angle amount VTd substantially matches the target advanced angle amount VTt (1 [degCA] or less) with the integral value Ii being steady, it is determined that the holding current learning condition is established. When the learning condition is established, the output current value Iout at that time is set as the holding current learned value Ih in step 1202.

Reverting again to FIG. 10, when it is determined in step 1008 that the target advanced angle amount VTt is less than the minimum deviation control value VTmn, a minimum current value Imin to be supplied to the electromagnetic coil 193 is set as the output current value Iout in step 1009. Though the minimum current value Imin may be 0 [mA], it is preferred that the minimum current value Imin be set to about 100 [mA] and supplied to the electromagnetic coil 193 so as to perform the next operation promptly.

When it is determined in step 1007 that the target advanced angle amount VTt is greater than the maximum deviation control value VTmx, then in step 1010, the sum of the holding current learned value Ih, proportional value Ip, derivative value Id and integral value Ii is compared with the sum of holding control current value Iv and a prescribed value Ic.

Figure 13:
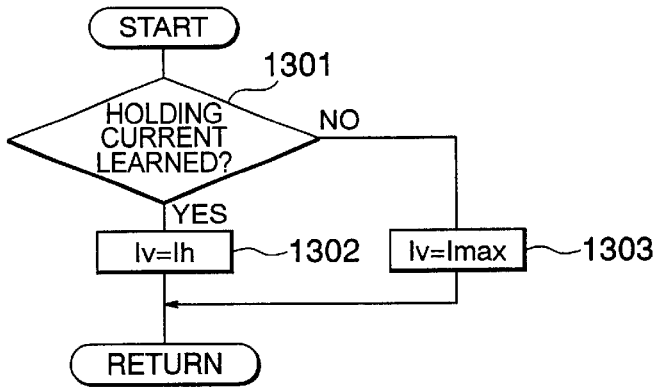
FIG. 13 is a flow chart illustrating how to determine a holding control current value Iv in the valve timing control apparatus for an internal combustion engine according to one embodiment of the present invention.

The holding control current value Iv is determined as follows. That is, as shown in a flow chart of FIG. 13, in step 1301, a determination is made whether the learning of the holding current learned value Ih is completed. When this learning is completed, then in step 1302, the holding current learned value Ih is set as the holding control current value Iv. When, however, it is determined in step 1301 that the learning of the holding current learned value Ih is not completed, the control maximum value Imax of the holding current value is set as the holding control current value Iv.

In addition, the prescribed value Ic is preferably set to such a current value (e.g., about 100 [mA]) as to stabilize the valve timing when added to the holding control current value Iv to provide the output current value Iout. The control maximum value Imax of the holding current value Iv is the maximum current value which can be taken due to variations in the characteristics of the OCV during holding control. The holding current learned value Ih is stored unless backup power supplied to the ECU 21 is cut off, for example, by removal of a backup power supply.

Reverting again to FIG. 10, when it is determined in step 1010 that the sum of the holding current learned value Ih, proportional value Ip, derivative value Id and integral value Ii is greater than the sum of the holding control current value Iv and the prescribed value Ic, then in step 1011, the sum of the holding current learned value Ih, proportional value Ip, derivative value Id and integral value Ii is set as the output current value Iout. Otherwise, the sum of the holding current learned value Ih, proportional value Ip, derivative value Id and integral value Ii is equal to or less than the sum of the holding control current value Iv and the prescribed value Ic, then in step 1012, the sum of the holding control current value Iv and the prescribed value Ic is set as the output current value Iout. Thereafter, in step 1016, the output current value Iout is converted into a corresponding duty, which is then output.

Next, the valve timing control operation carried out in accordance with the flow chart of FIG. 10 will be described while using a timing chart of FIG. 14.

First of all, at time point 1401, the target advanced angle amount VTt changes to the maximum advanced angle position, and up to time point 1402, the target advanced angle amount VTt is greater than the maximum deviation control value VTmx. However, since the sum of the holding current learned value Ih, proportional value Ip, derivative value Id and integral value Ii is greater than the sum of the holding control current value Iv and the prescribed value Ic, the processing of step 1011 of FIG. 10 is executed. That is, control is carried out by the output current value Iout corresponding to the deviation between the target advanced angle amount VTt and the actual advanced angle amount VTd.

Figure 10:
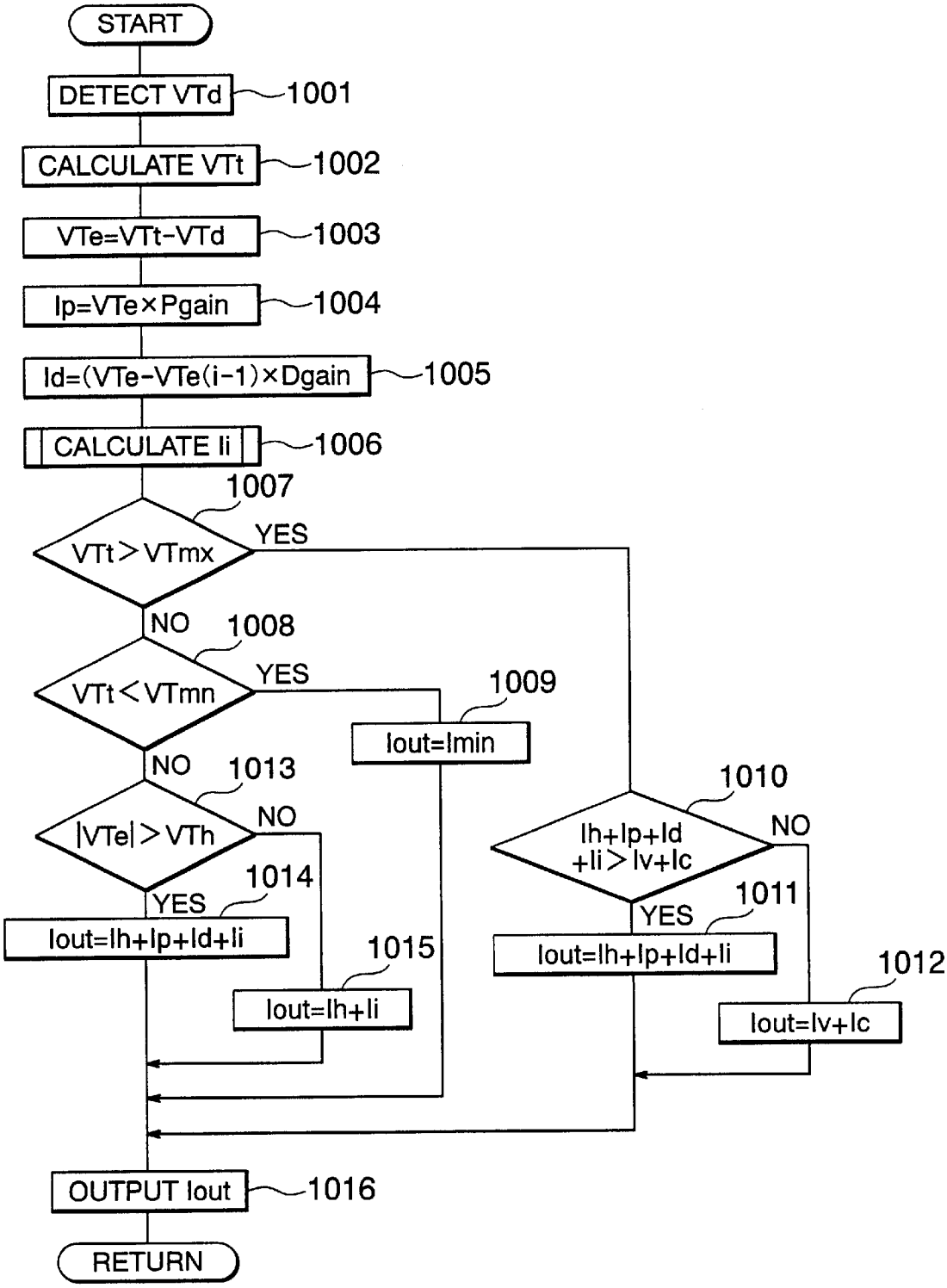
FIG. 10 is a flow chart illustrating the operation of a valve timing control apparatus for an internal combustion engine according to one embodiment of the present invention.

At time point 1402, the sum of the holding current learned value Ih, proportional value Ip, derivative value Id and integral value Ii becomes equal to or less than the sum of the holding control current value Iv and the prescribed value Ic, and hence the processing of step 1012 of FIG. 10 is executed. At this time, the output current value Iout becomes greater than a current value, represented by a broken line in FIG. 14, which is calculated from a deviation between the target advanced angle amount VTt and the actual advanced angle amount VTd, so that a force of the actuator urging the vanes to their mechanical stop positions is large, thus making the position control stable. Moreover, this is not controlled by the maximum current, so it is possible to avoid increased loads on the control circuit of the ECU 21 and the electromagnetic coil of the OCV.

Figure 18:
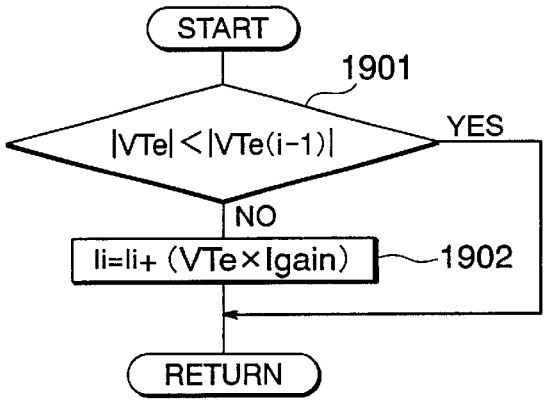
FIG. 18 is a flow chart illustrating how to calculate an integral value Ii in the known valve timing control apparatus for an internal combustion engine.
Figure 19:
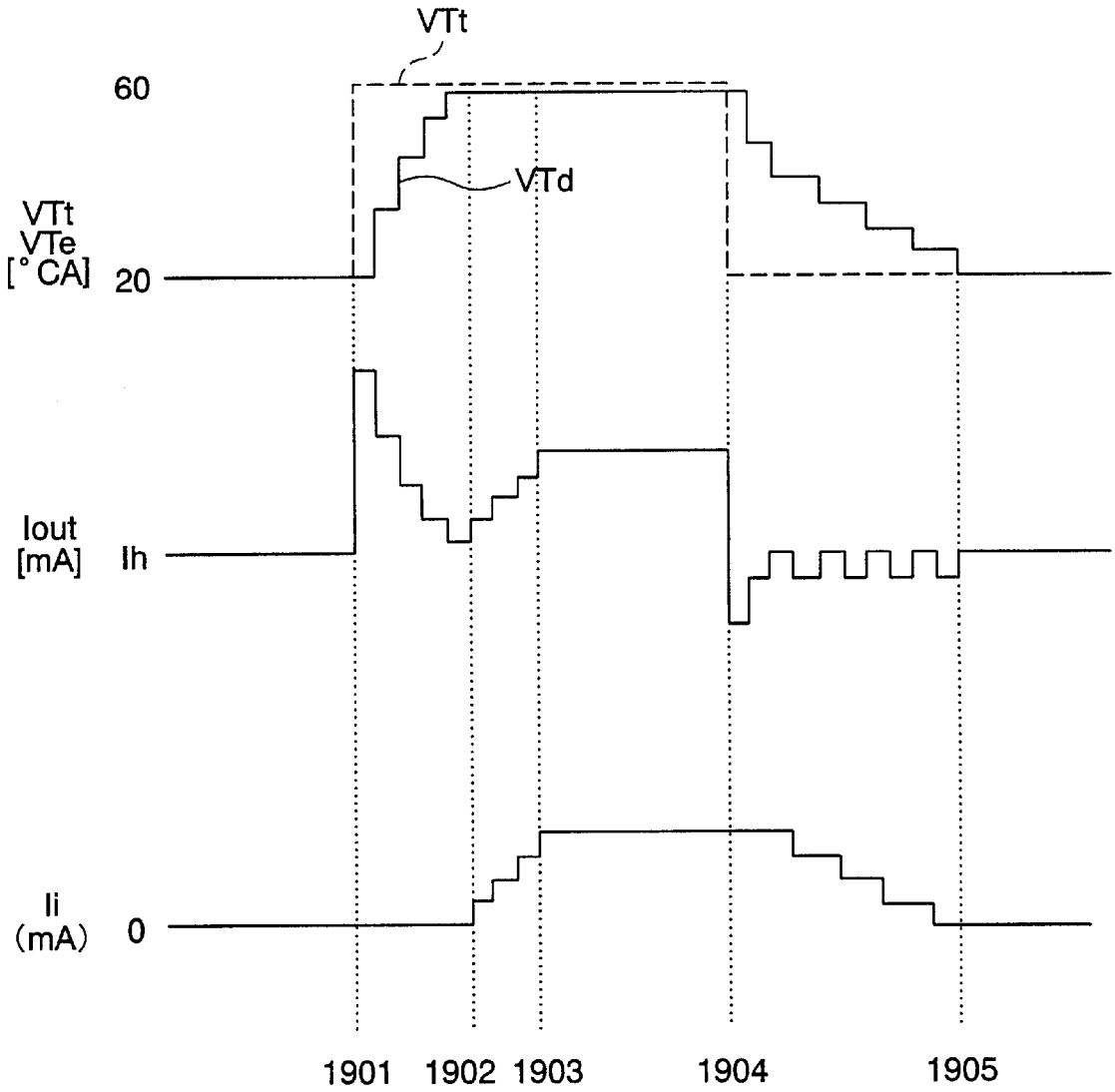
FIG. 19 is a timing chart illustrating the operation of the known valve timing control apparatus for an internal combustion engine.

When the target advanced angle amount VTt separates from the maximum advanced angle position at time point 1403, the output current value Iout is usually calculated based on the deviation between the target advanced angle amount VTt and the actual advanced angle amount VTd, so that the actual advanced angle VTd converges to the target advanced angle amount VTt at time point 1404. The integral value is held at the last value, and not updated like the integral value Ii indicated by the solid line between the time point 1402 and time point 1403. Therefore, the output current value Iout does not become incorrect value at time point 1403, and hence a reduction in response as illustrated in FIG. 18 does not result.

Thus, within the prescribed control range, the control amount is controlled to a value corresponding to the usual deviation between the target advanced angle amount VTt and the actual advanced angle amount VTd. Moreover, when the target advanced angle amount VTt is outside the prescribed control range. the control amount is not controlled to a value corresponding to the deviation between the target advanced angle amount VTt and the actual advanced angle amount VTd. Consequently, positional stability of the valve timing is improved. In addition, control is not performed by the maximum current value, so it is possible to avoid large loads on the control circuit of the ECU 21 and the electromagnetic coil of the OCV. Furthermore, when the target advanced angle amount VTt is outside the prescribed control range, the integral value is not updated, thereby avoiding a reduction in response when the integral value becomes within the prescribed control range.

In this first embodiment, in step 1010 of FIG. 10, the output current value Iout is determined based on a comparison between the sum of the holding current learned value Ih, proportional value Ip, derivative value Id and integral value Ii, and the sum of the holding current control value Iv and the prescribed value Ic. However, the step 1010 may be modified such that a determination is made whether the actual advanced angle amount VTd is less than the deviation control maximum value ITmx, and the output current value Iout is determined based on the advanced angle amount. In this case, similar effects can be obtained.

Embodiment 2

Now, another embodiment of the present invention will be described below. In the above-mentioned first embodiment, the integral value is not updated when the target advanced angle amount VTt is outside the control range. However, even if the integral value is updated when it is outside the control range, similar effects can be obtained by resetting the integral value when the target advanced angle amount VTt becomes within the control range. In this embodiment, control is carried out substantially in accordance with the flow chart of FIG. 10 as in the first embodiment, excepting that the calculation of the integral value Ii in step 1006 is replaced with the processing shown in a flow chart of FIG. 15.

Figure 15:
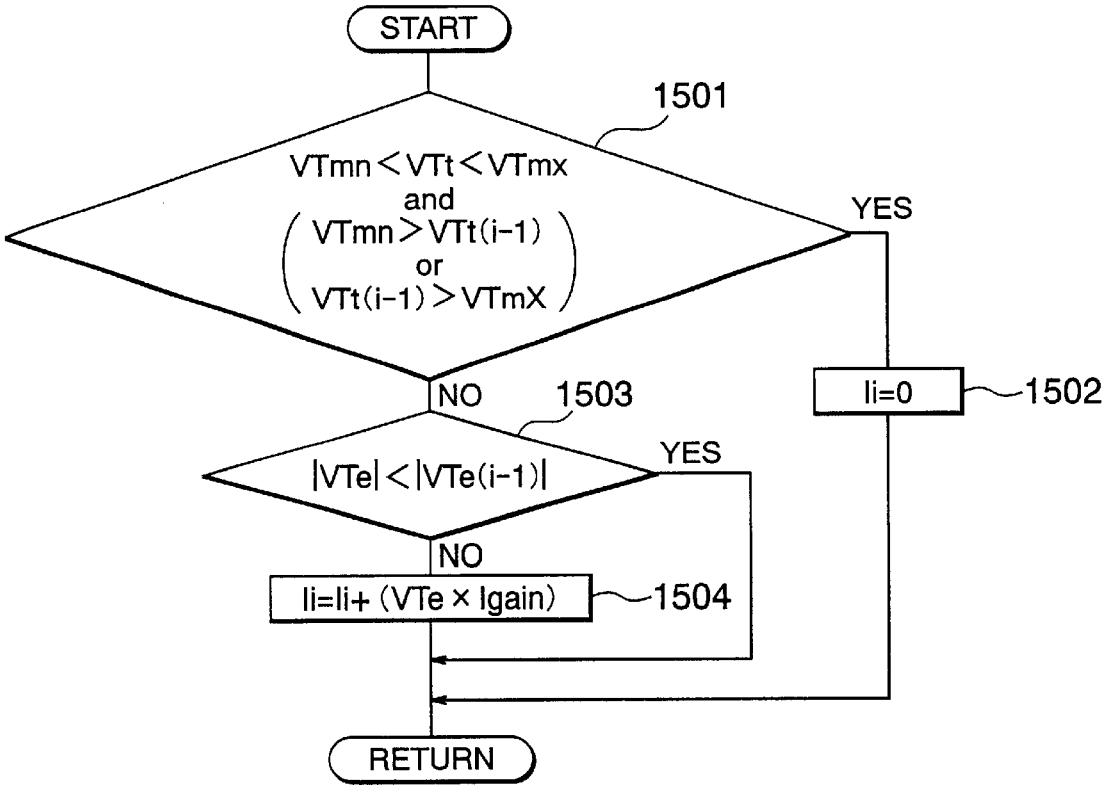
FIG. 15 is a flow chart illustrating the operation of the valve timing control apparatus for an internal combustion engine according to another embodiment of the present invention.

Specifically, in step 1501 of FIG. 15, it is determined whether the target advanced angle amount VTt is between the minimum deviation control value VTmn and the maximum deviation control value VTmx, and it is further determined whether the last target advanced angle amount VTt (i−1) is less than the minimum deviation control value VTmn, or whether the target advanced angle amount last value VTt(i−1) is greater than the maximum deviation control value VTmx. That is, a determination is made whether the target advanced angle amount VTt has changed from the outside of the control range into the control range. When there has been such a change, the integral value Ii is reset in step 1502. Otherwise, when there has not been such a change, the usual calculation of the integral value is performed. That is, when it is determined in step 1503 that the absolute value |VTe| of the control deviation is greater than the absolute value |VTe(i−1)| of the last control deviation, then in step 1504, the integral value Ii is calculated.

Figure 16:
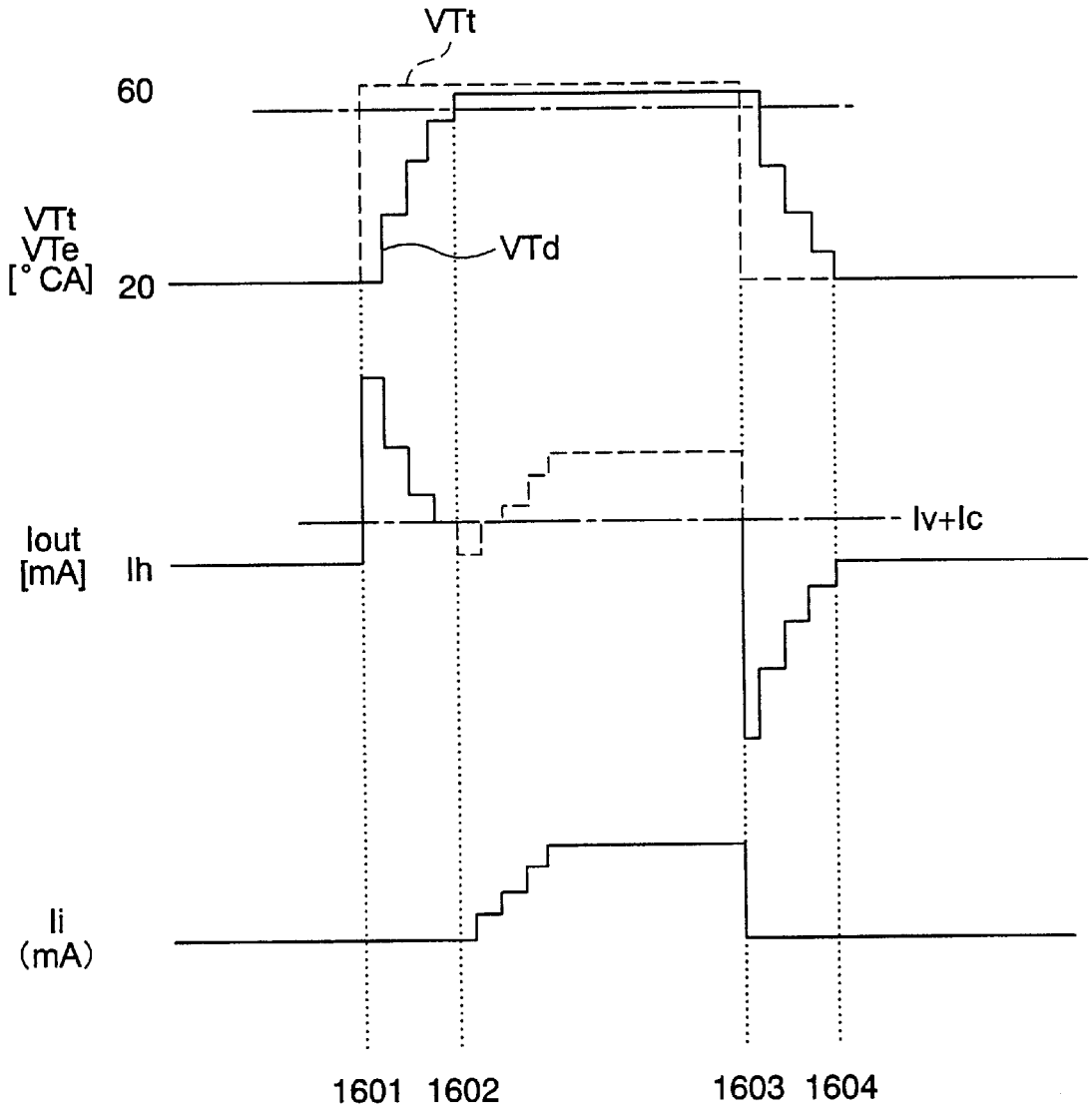
FIG. 16 is a timing chart illustrating the operation of the valve timing control apparatus for an internal combustion engine according to another embodiment of the present invention.
Figure 17:
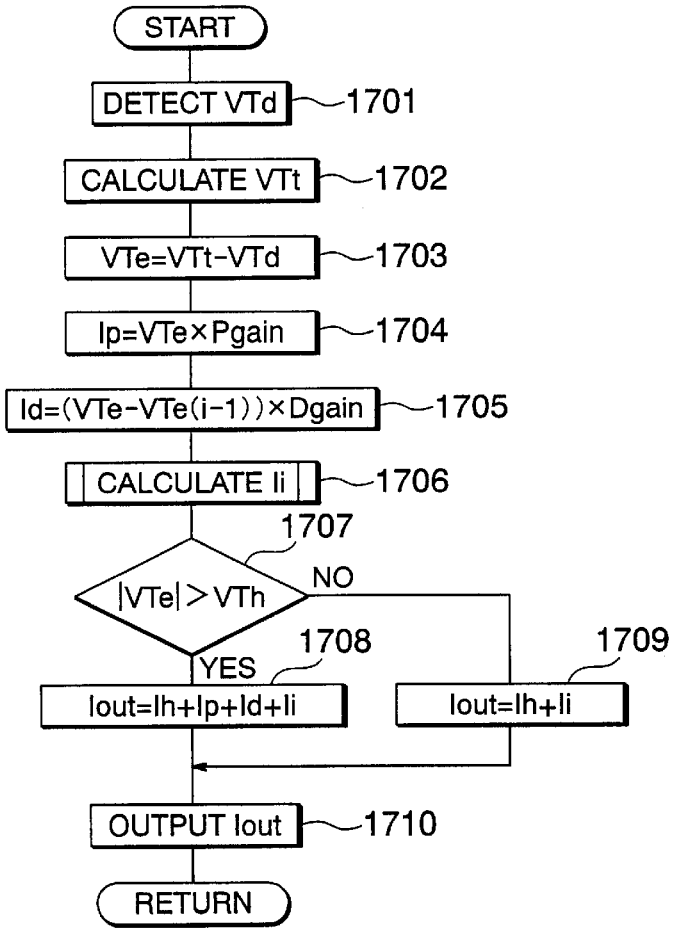
FIG. 17 is a flow chart illustrating the operation of a known valve timing control apparatus for an internal combustion engine.

Next, the operation of this embodiment will be described while using a timing chart of FIG. 16. At time point 1601, the target advanced angle amount VTt changes to the maximum advanced angle position, and up to time point 1602, the target advanced angle amount VTt is greater than the maximum deviation control value VTmx. However, since the sum of the holding current learned value Ih, proportional value Ip, derivative value Id and integral value Ii is greater than the sum of the holding control current value Iv and the prescribed value Ic, the processing in step 1011 of FIG. 10 is carried out, and control is performed by the output current value Iout corresponding to the deviation between the target advanced angle amount VTt and the actual advanced angle amount VTd.

Since at time point 1602, the sum of the holding current learned value Ih, proportional value Ip, derivative value Id and integral value Ii becomes equal to or less than the sum of the holding control current value Iv and the prescribed value Ic, the processing in step 1012 of FIG. 10 is carried out. At this time, the output current value Iout becomes greater than a current value, represented by a broken line in FIG. 14, which is calculated from the deviation between the target advanced angle amount VTt and the actual advanced angle amount VTd, so that a force of the actuator urging the vanes to their mechanical stop positions is large, thus making the position control stable. In addition, control is not performed by the maximum current value, so it is possible to avoid large loads on the control circuit of the ECU 21 and the electromagnetic coil of the OCV.

When the target advanced angle amount VTt separates from the maximum advanced angle position at time point 1603, the output current value Iout is usually calculated based on the deviation between the target advanced angle amount VTt and the actual advanced angle amount VTd. As a result, the actual advanced angle amount VTd converges to the target advanced angle amount VTt at time point 1604. Although the integral value Ii is updated between the time point 1602 and the time point 1603, the integral value is reset at the time point 1603, and hence the output current value Iout does not become an incorrect value. Consequently, a reduction in response as illustrated in FIG. 18 does not result.

Thus, even if the integral value is updated when the target advanced angle amount VTt is outside the control range, it is possible to prevent a reduction in response by resetting the integral value when the target advanced angle amount VTt becomes within the control range.

Figure 14:
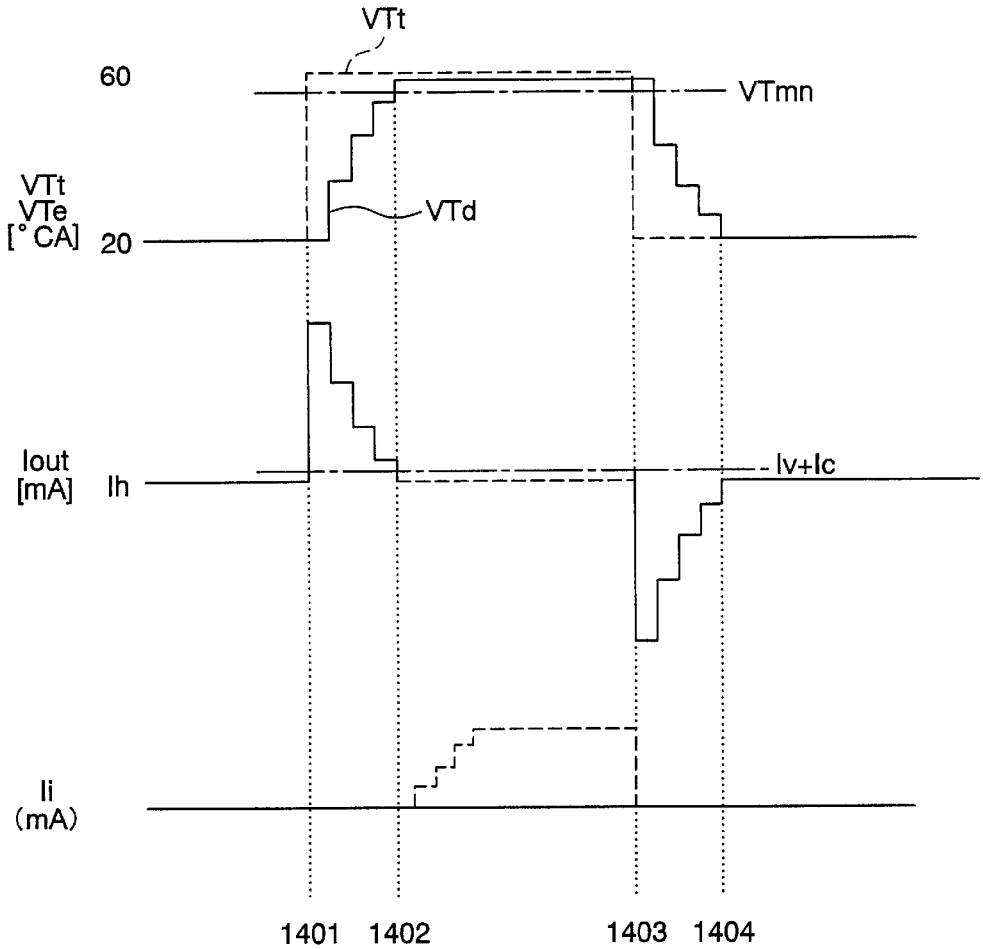
FIG. 14 is a timing chart illustrating the operation of the valve timing control apparatus for an internal combustion engine according to one embodiment of the present invention.

Even if the integral value Ii is updated between the time point 1402 and the time point 1403, as illustrated by the broken line in FIG. 14, it is possible to prevent the result of the update from being reflected on the output current value Iout. In this case, too, when the target advanced angle amount VTt becomes within the control range, the integral value Ii is reset.

In the present invention, a control amount is usually set corresponding to the deviation between the target advanced angle amount VTt and the actual advanced angle amount VTd when the target advanced angle amount VTt is within the prescribed control range. Otherwise, the control amount is set to a value different from the one corresponding to the deviation between the target advanced angle amount VTt and the actual advanced angle amount VTd when the target advanced angle amount VTt is outside the control range. Therefore, good response is ensured when the target advanced angle amount VTt is within the control range. In addition, positional stability is improved when the target advanced angle amount VTt is outside the control range.

Moreover, by making the control amount not equal to a maximum control amount, it is possible to avoid increased loads on the control circuit of the ECU 21 and the electromagnetic coil of the OCV.

Further, it is possible to prevent a variation in the control amount when the target advanced angle amount VTt is shifted into the control range from the outside of the control range, by stopping the calculation of the integral value outside the control range, or by prohibiting the reflection of the integral value on the control amount, or by resetting the integral value when the target advanced angle amount VTt shifts from the outside of the control range into the control range.

As described in the foregoing, according to the present invention, the control amount is set to a value corresponding to a usual deviation between the target advanced angle amount VTt and the actual advanced angle amount VTd within the prescribed control range. In addition, the control amount is set to a value different from the one corresponding to the deviation between the target advanced angle amount VTt and the actual advanced angle amount VTd when the target advanced angle amount VTt is outside the control range. As a result, it is possible to ensure good response when the target advanced angle amount VTt is within the control range. Moreover, positional stability can be improved when the target advanced angle amount VTt is outside the control range. Additionally, when the target advanced angle amount VTt is outside the control range, the control amount is not made to the maximum control amount, whereby durability is ensured without increasing loads on the electromagnetic coil of the OCV and the control circuit of the ECU and without increasing the capacity of electric power thereof.

Furthermore, it is possible to prevent a variation in the control amount when the target advanced angle amount VTt is shifted into the control range from the outside of the control range, by stopping the calculation of the integral value outside the control range, or by prohibiting the reflection of the integral value on the control amount, or by resetting the integral value when the target advanced angle amount VTt shifts from the outside of the control range into the control range. As a result, good response in the valve timing control is ensured to a satisfactory extent.

While the invention has been described in terms of preferred embodiments, those skilled in the art will recognize that the invention can be practiced with modifications within the spirit and scope of the appended cliams.

What is claimed is:

1. A valve timing control apparatus for an internal combustion engine comprising:

an intake valve and an exhaust valve driven to operate in synchronization with rotation of the engine;

an engine operating condition detecting section for detecting operating conditions of the engine;

a valve timing calculating section for calculating a target valve timing for at least one of said intake valve and said exhaust valve in accordance with the engine operating conditions;

a variable valve timing mechanism for varying an opening timing and a closing timing of at least one of said intake valve and said exhaust valve;

a valve timing detecting section for detecting an actual valve timing of at least one of said intake valve and said exhaust valve;

a control value calculating section for calculating a control value based on said target valve timing, said actual valve timing and said engine operating conditions;

an actual valve timing control section for outputting said control value as an output control value to said variable valve timing mechanism;

wherein only when said target valve timing is within a prescribed control range, said control value, which corresponds to a deviation between said target valve timing and said actual valve timing calculated by said control value calculating section, is output as said output control value to said actual valve timing control section; and wherein when said target valve timing is outside said control range on a side where said control value is set to a large value, said output control value is made equal to the sum of a holding control value and a predetermined value.

2. The valve timing control apparatus for an internal combustion engine according to claim 1, wherein said holding control value is said output control value in a state in which said actual valve timing substantially matches said target valve timing when said target valve timing is within said control range.

3. The valve timing control apparatus for an internal combustion engine according to claim 1, further comprising a holding control value learning section for learning said output control value in a state in which said actual valve timing substantially matches said target valve timing when said target valve timing is within said control range.

4. The valve timing control apparatus for an internal combustion engine according to claim 3, wherein said holding control value is set as a maximum control value when said holding control value learning section does not perform a learning operation.

5. The valve timing control apparatus for an internal combustion engine according to claim 1, where said prescribed value is set to said output control value with which at least said actual valve timing is stopped at a mechanical stop position.

6. The valve timing control apparatus for an internal combustion engine according to claim 1, wherein when said control value calculated by said control value calculating section is greater than the sum of said holding control value and a prescribed value or when said actual valve timing is within said control range, even with said target valve timing being outside said control range, said control value calculated by said control value calculating section is made as said output control value.

7. A valve timing control apparatus for an internal combustion engine comprising:

an intake valve and an exhaust valve driven to operate in synchronization with rotation of the engine;

an engine operating condition detecting section for detecting operating conditions of the engine;

a valve timing calculating section for calculating a target valve timing for at least one of said intake valve and said exhaust valve in accordance with the engine operating conditions;

a variable valve timing mechanism for varying an opening timing and a closing timing of at least one of said intake valve and said exhaust valve;

a valve timing detecting section for detecting an actual valve timing of at least one of said intake valve and said exhaust valve;

a control value calculating section for calculating a control value based on said target valve timing, said actual valve timing and said engine operating conditions;

an actual valve timing control section for outputting said control value as an output control value to said variable valve timing mechanism;

wherein only when said target valve timing is within a prescribed control range, said control value, which corresponds to a deviation between said target valve timing and said actual valve timing calculated by said control value calculating section, is output as said output control value to said actual valve timing control section; and further comprising an integral control section for integrating a deviation between said target valve timing and said actual valve timing to provide an integral correction value for correcting said control value calculated by said control value calculating section, wherein said integral correction value is corrected to said control value calculated by said control value calculating section, and when said target valve timing is outside said control range, said control value is set in such a manner as to inhibit said integral correction value from being updated.

8. A valve timing control apparatus for an internal combustion engine comprising:

an intake valve and an exhaust valve driven to operate in synchronization with rotation of the engine;

an engine operating condition detecting section for detecting operating conditions of the engine;

a valve timing calculating section for calculating a target valve timing for at least one of said intake valve and said exhaust valve in accordance with the engine operating conditions;

a variable valve timing mechanism for varying an opening timing and a closing timing of at least one of said intake valve and said exhaust valve;

a valve timing detecting section for detecting an actual valve timing of at least one of said intake valve and said exhaust valve;

a control value calculating section for calculating a control value based on said target valve timing, said actual valve timing and said engine operating conditions;

an actual valve timing control section for outputting said control value as an output control value to said variable valve timing mechanism;

wherein only when said target valve timing is within a prescribed control range, said control value, which corresponds to a deviation between said target valve timing and said actual valve timing calculated by said control value calculating section, is output as said output control value to said actual valve timing control section; and further comprising an integral control section for integrating a deviation between said target valve timing and said actual valve timing to provide an integral correction value for correcting said control value calculated by said control value calculating section, wherein said integral correction value corresponds to said control value calculated by said control value calculating section, and when said target valve timing is outside said control range, said control value is set in such a manner as to inhibit said integral correction value from being used to correct said control value.

9. A valve timing control apparatus for an internal combustion engine comprising:

an intake valve and an exhaust valve driven to operate in synchronization with rotation of the engine;

an engine operating condition detecting section for detecting operating conditions of the engine;

a valve timing calculating section for calculating a target valve timing for at least one of said intake valve and said exhaust valve in accordance with the engine operating conditions;

a variable valve timing mechanism for varying an opening timing and a closing timing of at least one of said intake valve and said exhaust valve;

a valve timing detecting section for detecting an actual valve timing of at least one of said intake valve and said exhaust valve;

a control value calculating section for calculating a control value based on said target valve timing, said actual valve timing and said engine operating conditions;

an actual valve timing control section for outputting said control value as an output control value to said variable valve timing mechanism;

wherein only when said target valve timing is within a prescribed control range, said control value, which corresponds to a deviation between said target valve timing and said actual valve timing calculated by said control value calculating section, is output as said output control value to said actual valve timing control section; and further comprising an integral control section for integrating a deviation between said target valve timing and said actual valve timing to provide an integral correction value for correcting said control value calculated by said control value calculating section, wherein said integral correction value corresponds to said control value calculated by said control value calculating section, and when said target valve timing changes from the outside of said control range into said control range, said integral correction value is initialized.

* * * * *